US011117709B2

(12) United States Patent
Siskindovich

(10) Patent No.: US 11,117,709 B2
(45) Date of Patent: Sep. 14, 2021

(54) MODULAR CONTAINER SYSTEM HAVING AN INTERIOR DIVIDABLE INTO COMPARTMENTS OF VARIABLE SIZE

(71) Applicant: Sabert Corporation, Sayrevillle, NJ (US)

(72) Inventor: Yohanan Siskindovich, Glen Ridge, NJ (US)

(73) Assignee: SABERT CORPORATION, Sayrevillle, NJ (US)

( * ) Notice: Subject to any disclaimer, the term of this patent is extended or adjusted under 35 U.S.C. 154(b) by 115 days.

(21) Appl. No.: 16/790,138

(22) Filed: Feb. 13, 2020

(65) Prior Publication Data

US 2020/0262611 A1 Aug. 20, 2020

Related U.S. Application Data

(60) Provisional application No. 62/807,517, filed on Feb. 19, 2019.

(51) Int. Cl.
*B65D 25/06* (2006.01)
*B65D 43/02* (2006.01)

(52) U.S. Cl.
CPC ..... *B65D 25/06* (2013.01); *B65D 43/0208* (2013.01); *B65D 2543/00194* (2013.01); *B65D 2543/00296* (2013.01); *B65D 2543/00842* (2013.01)

(58) Field of Classification Search
CPC ..... B65D 25/04; B65D 25/06; B65D 1/36; B42F 17/06; B42F 17/12
USPC ..... 220/510, 529, 530, 531, 539, 541, 544, 220/545, 546, 550
See application file for complete search history.

(56) References Cited

U.S. PATENT DOCUMENTS 1,700,317 A * 1/1929 Kamenstein ..... B42F 17/02 220/529
9,314,143 B2 * 4/2016 Bensussan ..... F16J 15/025
2014/0026521 A1 * 1/2014 Beal ..... B65D 25/06 53/428
2019/0100370 A1 * 4/2019 Kieling ..... B65D 43/162
2020/0384143 A1 * 12/2020 Burmeister ..... A61B 50/34

* cited by examiner

*Primary Examiner* — Jeffrey R Allen
(74) *Attorney, Agent, or Firm* — Cozen O'Connor

(57) ABSTRACT

A modular container system has an interior dividable into compartments of variable size and includes a base having a bottom and sidewalls extending from the bottom to define an interior volume. At least one opposing pair of the sidewalls have regions arranged opposite each other, each of the regions including protrusions to form pairs of opposing protrusions, each of the regions further including indents positioned in correspondence with the protrusions. At least one barrier extends between the opposing protrusions to divide the interior volume of the base into a plurality of compartments. The barrier has an elongate body and a tab portion extending from each end of the body. Each tab portion is bendable to orient an underside of each tab portion to face a respective protrusion, a longitudinal end of each said tab portion engaging with a corresponding indent, to form a press-fit coupling.

19 Claims, 8 Drawing Sheets

MODULAR CONTAINER SYSTEM HAVING AN INTERIOR DIVIDABLE INTO COMPARTMENTS OF VARIABLE SIZE

CROSS-REFERENCE TO RELATED APPLICATION

This application claims benefit under 35 U.S.C. § 119(e) of U.S. Provisional application No. 62/807,517, filed Feb. 19, 2019, the entirety of which is incorporated by reference herein.

BACKGROUND OF THE INVENTION

Field of the Invention

The present invention is directed to a modular container system having an interior dividable into compartments of variable size.

Description of the Related Art

It is sometimes necessary to store a number of different types of food items in a single container, such as in packaging restaurant take-out food or leftovers to be taken home by a customer. In conventional approaches, due to cost and other factors, foods with different consistencies and temperature requirements are stored in a manner which does not maintain food quality. For example, a warm entrée may be packaged with a cold side dish, and crispy foods, such as fried potatoes, may be packaged with a main course having a gravy, sauce, marinade, and the like. Moreover, conventional approaches to storing and delivering food may result in degraded food presentation. For example, food take-out containers often have a transparent or translucent cover to allow the customer to view the food. During transport, however, food in the container may shift—arriving at its destination in an undesirable visual state. This is particularly the case when a container contains multiple food items, such as, for example, a salad with a main course.

Furthermore, while it is possible to achieve better food separation and minimize food shifting during transit using different and existing divided food containers; food providers face a challenge in having to store and use a number of fixed divided packaging solutions to fit a large and ever-changing menu. Conventional approaches may not provide SKU (Stock Keeping Unit) reduction to minimize costs, storage requirements and complexity in operations.

Thus, conventional approaches to storing food may not provide cost effective solutions for maintaining the quality and presentation of different food items while minimizing the number of food container SKU components.

SUMMARY OF THE INVENTION

The disclosed embodiments are directed to a container system for displaying, transporting, storing, and serving food that includes a container base and dividers (e.g., barriers). A container lid may also be included. The system provides a modular food container system for use in both hot and cold food applications, even simultaneously. Implementations of the system may use a container base, one or more removably-attachable dividers affixed to the base, and a lid which is removably affixed to the base. The lid may be formed of transparent or translucent plastic material to allow for observation of the contents of the container and may engage in a snap fit with the base. In implementations, the snap-fit engagement may form a leak-proof seal. In embodiments in which food is meant to be served but not transported, such as an in-store environment, a lid may not be needed.

The container may have a number of locking features to provide variation in the configuration of the container system. For example, a container base with one opposing pair of locking features (e.g., one on each of an opposing pair of substantially parallel sidewalls) provides two variations: undivided, i.e., no divider is present such that the container system defines a single unseparated content carrying space, and divided (e.g., into two sections of the space) to define two content carrying spaces. A container base with three spaced opposing pairs of locking features will provide four variations: undivided, divided (e.g., two, one-half sections) using a single divider at a midway position, divided (e.g., a one-third section and a two-thirds section) using a single divider at a one-third position, and divided using two dividers (e.g., into three, one-third sections), with one divider at a one-third position (e.g., to the left of the center position) and a second divider at a two-thirds position (e.g., to the right of the center position).

The container system described herein provides simplicity and ease of operation. The locking features are intuitive to use and require little to no training. Inserting a divider into place is performed by a press-fit operation. The dividers may be manufactured in a bundle or sheet, so the user can tear away the number of dividers needed. This approach to design and manufacturing reduces cost, efficiently uses space, and helps operationally by reducing the number of small loose parts in a kitchen environment.

A modular container system having an interior dividable into compartments of variable size may be summarized as including a base having a bottom and sidewalls extending from the bottom to define an interior volume, at least one opposing pair of the sidewalls having regions arranged opposite each other, each of the regions including one or more protrusions to form one or more pairs of opposing protrusions, each of the regions further including one or more indents positioned in correspondence with the one or more protrusions, the base having a rim at a peripheral upper edge of the sidewalls; and at least one barrier to extend between the one or more pairs of opposing protrusions to divide the interior volume of the base into a plurality of compartments, the at least one barrier having an elongate body and a tab portion extending from each end of the body, each said tab portion being bendable to orient an underside of each said tab portion to face a respective protrusion of the one or more pairs of opposing protrusions, a longitudinal end of each said tab portion engaging with a corresponding indent of the one or more indents, to form a press-fit coupling between each said tab portion and the respective protrusion of the one or more pairs of opposing protrusions and the corresponding indent of the one or more indents, such that when the at least one barrier is so positioned, a length of the barrier is substantially the same as a distance between the regions of the at least one opposing pair of the sidewalls.

Embodiments of the modular container system may include one or more of the following features.

Each said tab portion may have an opening on the underside thereof and the respective protrusion of the one or more pairs of opposing protrusions is sized and shaped to fit at least partially within the opening on the underside of each said tab portion when forming the press-fit coupling. The regions of the at least one opposing pair of the sidewalls may be substantially planar. The modular container system may further include a lid having a rim at a peripheral edge thereof to attach to the rim of the base. At least one barrier may be formed as part of a plurality of barriers which are detachably connected as a single sheet.

The body of the at least one barrier may have sides which slope so that a transverse width of the body narrows from a bottom of the body to a top of the body. The body of the at least one barrier may have ends which slope so that a longitudinal length of the body narrows from a bottom of the body to a top of the body. Each said tab portion of the at least one barrier may have a top which slopes so that a height of each said tab portion decreases in the longitudinal direction of the body from an end of the body to a longitudinal middle of the body. The sloped ends of the body of the at least one barrier and the sloped top of each said tab portion, respectively, may be shaped to be substantially parallel when the press-fit coupling is made between each said tab portion and the respective protrusion of the one or more pairs of opposing protrusions and the corresponding indent of the one or more indents. The substantially parallel sloped ends of the body of the at least one barrier and the sloped top of each said tab portion, respectively, may have a gap therebetween, when the press-fit coupling is made between each said tab portion and the respective protrusion of the one or more pairs of opposing protrusions and the corresponding indent of the one or more indents, to provide space for each said tab portion to be moved inward, in a longitudinal direction of the body, toward the middle of the body to disengage the press-fit coupling.

Each of the regions of the at least one opposing pair of the sidewalls may include at least two pairs of opposing protrusions positioned so that the interior volume of the base can be selectively divided into at least: an approximately one-third portion and an approximately two-thirds portion; and three approximately one-third portions. Each of the regions of the at least one opposing pair of the sidewalls may include at least three pairs of opposing protrusions positioned so that the interior volume of the base can be selectively divided into at least: two equally-sized portions; an approximately one-third portion and an approximately two-thirds portion; and three approximately one-third portions. An interior surface of the bottom of the base may include at least one elongate raised portion positioned and shaped to fit within an underside opening of the body of the at least one barrier, the raised portion including raised tabs at ends thereof, the raised tabs positioned to engage with ends of the underside opening of the body of the at least one barrier. An interior surface of the bottom of the base may include raised tabs spaced apart from the at least one opposing pair of the sidewalls, the raised tabs positioned to engage with ends of an underside opening of the body of the at least one barrier.

A plastic container having an interior dividable into compartments of variable size may be summarized as including a base adapted to receive at least one barrier to divide the interior volume of the base into a plurality of compartments, the base including: a bottom having an interior surface, sidewalls extending from the bottom to define an interior volume, at least one opposing pair of the sidewalls having regions arranged opposite each other, each of the regions including one or more protrusions to form one or more pairs of opposing protrusions, each of the regions further including one or more indents positioned in correspondence with the one or more protrusions, the one or more pairs of opposing protrusions adapted to receive the at least one barrier extending therebetween, the one or more pairs of opposing protrusions forming a press-fit coupling between each protrusion of the one or more pairs of opposing protrusions and a corresponding indent of the one or more indents and a respective bendable tab portion extending from each end of an elongate body portion of the at least one barrier, the corresponding indent of the one or more indents engaging with a longitudinal end of each said tab portion, and a rim at a peripheral upper edge of the sidewalls.

Embodiments of the plastic container may include one or more of the following features.

The container may further include a lid having a rim at a peripheral edge thereof to attach to the rim of the base. The one or more pairs of opposing protrusions of the base may be positioned and shaped so that the respective bendable tab portion of the at least one barrier is bendable to orient an underside of each said tab portion to face a respective protrusion of the one or more pairs of opposing protrusions. The interior surface of the bottom of the base may include at least one elongate raised portion positioned and shaped to fit within an underside opening of the body of the at least one barrier, the raised portion including raised tabs at ends thereof, the raised tabs positioned to engage with ends of the underside opening of the body of the at least one barrier. An interior surface of the bottom of the base may include raised tabs spaced apart from the at least one opposing pair of the sidewalls, the raised tabs positioned to engage with ends of an underside opening of the body of the at least one barrier. Other objects and features of the present invention will become apparent from the following detailed description considered in conjunction with the accompanying drawings. It is to be understood, however, that the drawings are designed solely for purposes of illustration and not as a definition of the limits of the invention. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings, identical reference numbers identify similar elements or acts. The sizes and relative positions of elements in the drawings are not necessarily drawn to scale. For example, the shapes of various elements and angles are not necessarily drawn to scale, and some of these elements are arbitrarily enlarged and positioned to improve drawing legibility. Further, the particular shapes of the elements as drawn, are not necessarily intended to convey any information regarding the actual shape of the particular elements, and have been solely selected for ease of recognition in the drawings.

DETAILED DESCRIPTION

Figure 1:
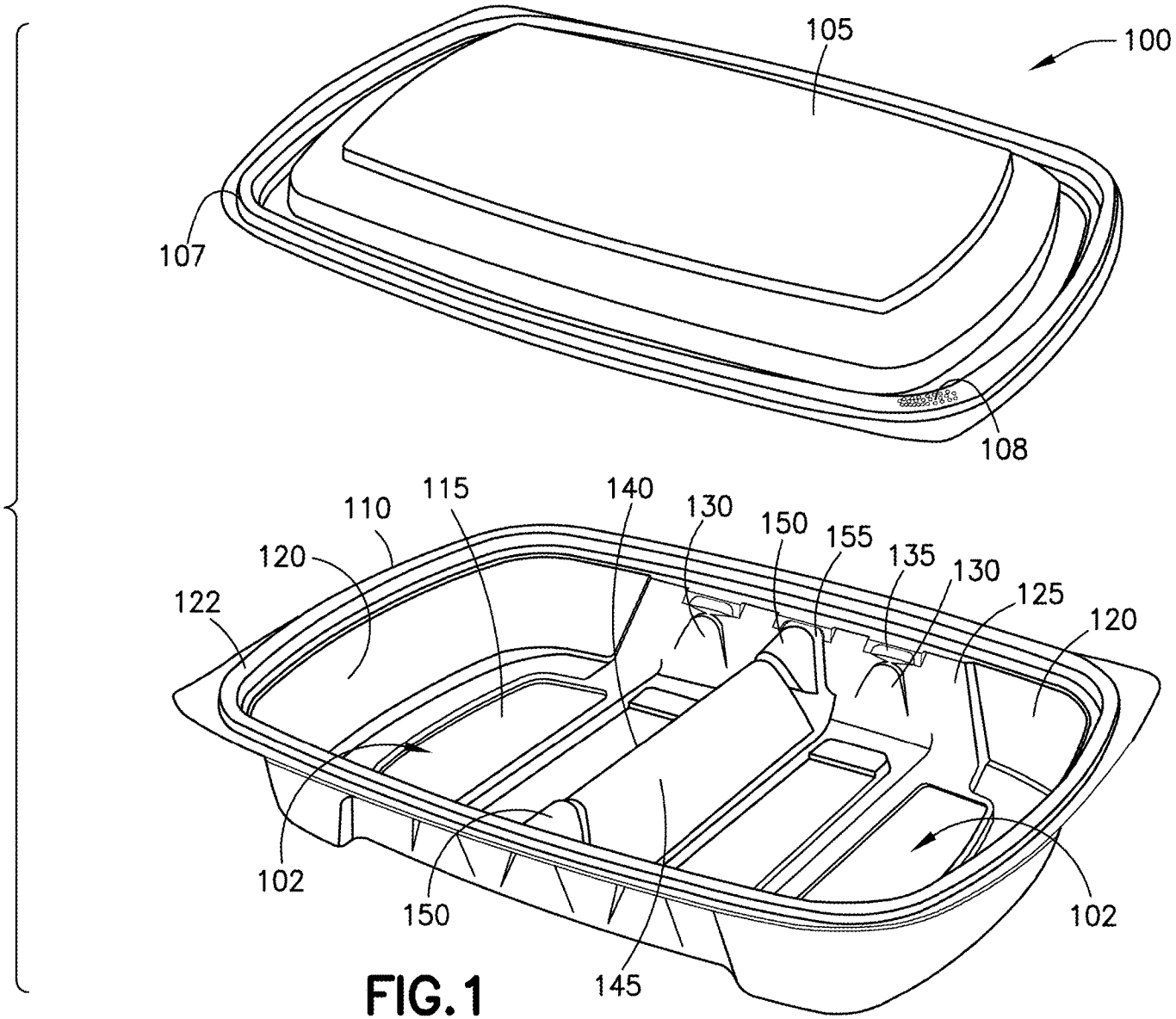
FIG. 1 is a perspective view of a modular container system and lid having an interior divided into two compartments, according to at least one illustrated implementation.

FIG. 1 is a perspective view of a modular container system 100 and lid 105. In implementations, the modular container system 100 has an interior dividable into compartments 102 of variable size. The modular container system 100 includes a base 110 having a bottom 115 and sidewalls 120 extending from the bottom to define an interior volume. The base 110 has at least one opposing pair of sidewalls 120 having regions 125 arranged opposite each other. In implementations, the regions 125 of the opposing pair of sidewalls 120 are substantially planar and may also be substantially parallel to one another. Each of the regions 125 has one or more protrusions 130 to form one or more pairs of opposing protrusions (the region and protrusions of one side are not fully visible in FIG. 1). Each of the regions 125 of the opposing pair of sidewalls 120 and one or more indents 135 positioned in correspondence with the protrusions 130. The base 110 has a rim 122 at a peripheral upper edge of the sidewalls 120. In implementations, the modular container system 100 includes a transparent or translucent lid 105 having a rim 107 at a peripheral edge thereof to attach to the rim 122 of the base 110. The lid 105 may be releasably secured to the base 110, such as in a snap-fit arrangement. As depicted, at least one corner of the lid 105 may include an enlarged overhang to provide a grip portion 108 to facilitate easy separation of the lid 105 from the base 110.

In the example depicted, a single barrier 140 has been installed in the base 110 to divide the interior of the base 110 into two approximately equally-sized compartments 102. The compartments 102 may, for example, contain different foods which are separated by the barrier 140. It should be noted that, in this example, the base 110 is configured to accept three barriers but that only one is used. Alternatively, the barrier 140 can be mounted to a different protrusion 130 such that the compartments 102 can be configured as having a one-third volume compartment and a two-third volume compartment. It is also possible to have more than one barrier 140, as discussed in further detail below, or no barrier 140 to leave the container undivided.

In implementations, there is at least one barrier 140 which extends between the one or more pairs of opposing protrusions 130 to divide the interior volume of the base 110 into a number of compartments 102. The barrier 140 (see FIG. 2A) has an elongate body 145 and a tab portion 150 extending from each end of the body 145. Each tab portion 150 is bendable to orient an underside 155 of each tab portion 150 to face a respective protrusion 130 to form a press-fit coupling, i.e., a coupling between each tab portion 150 and the respective protrusion 130 of the one or more pairs of opposing protrusions 130 and the corresponding indent 135 of the one or more indents 135. When the barrier 140 is so positioned, a length of the barrier 140 is substantially the same as the distance between the regions 125 of the opposing pair of sidewalls 120.

Described in different terms, the base 110 includes a bottom surface bottom 115 bounded by upwardly extending sidewalls 120. At least two of the sidewalls 120 have opposing portions (e.g., regions 125) which, in implementations, are substantially parallel to each other. The substantially parallel regions 125 include one or more designated locking features, e.g., protrusions 130 and indents 135, to which an attachable/detachable divider, e.g., barrier 140, can be secured, providing further flexibility in food presentation and transport. Each barrier 140 has a mating feature at each end, e.g., tab portion 150, which releasably secures to a respective locking feature, e.g., protrusion 130, on an inner surface of a base sidewall 120 at regions 125. Although such a container system 100 is meant to be disposable, it can also be reusable by a consumer because the barriers 140 can be easily detached and the components of the container system 100 can then be washed.

FIGS. 2A-2D are perspective views of a barrier 140 being installed in the base 110 of a modular container system 100, according to at least one illustrated implementation. In implementations, the base 110 may be substantially rectangular with a pair of opposing sidewalls 120 having parallel opposing portions (e.g., regions 125) which support locking features (e.g., protrusions 130 and indents 135), which, in the example depicted, are raised triangular elements extending inward from each region 125. Three such features (e.g., protrusions 130) on each long wall 121 of the base 110 are provided in this example (the protrusions of one side of the base are not directly visible), but this number may vary depending on the size and intended use of the container. In implementations, an interior surface of the bottom 115 of the base 110 may include raised tabs 175 spaced apart from the opposing pair of sidewalls 120 and at least one elongate raised portion 185, the purpose of which is discussed in further detail below (see FIGS. 3 and 4).

Figure 2A:
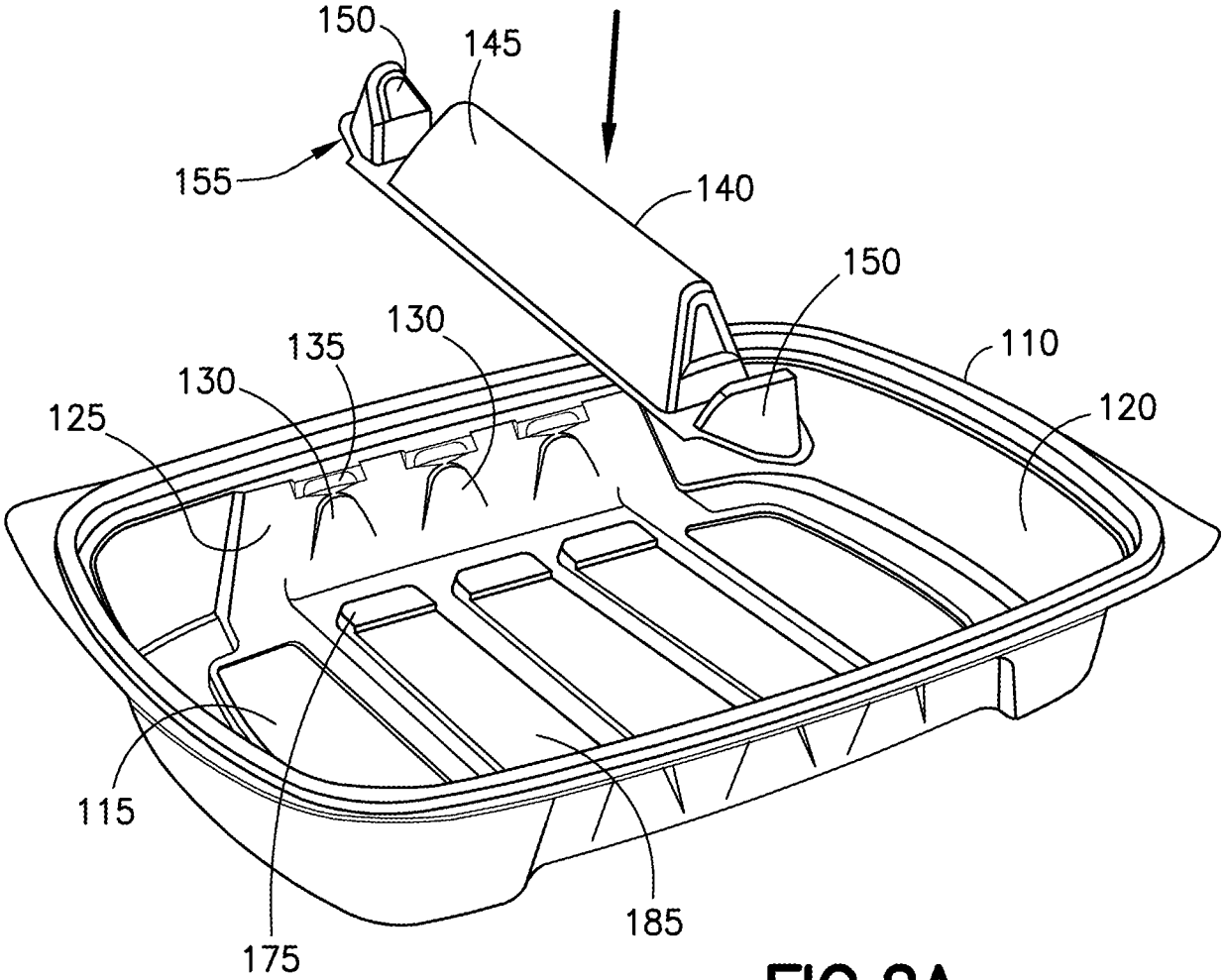
FIGS. 2A-2D are perspective views of a barrier being installed in the base of a modular container system, according to at least one illustrated implementation.
Figure 2B:
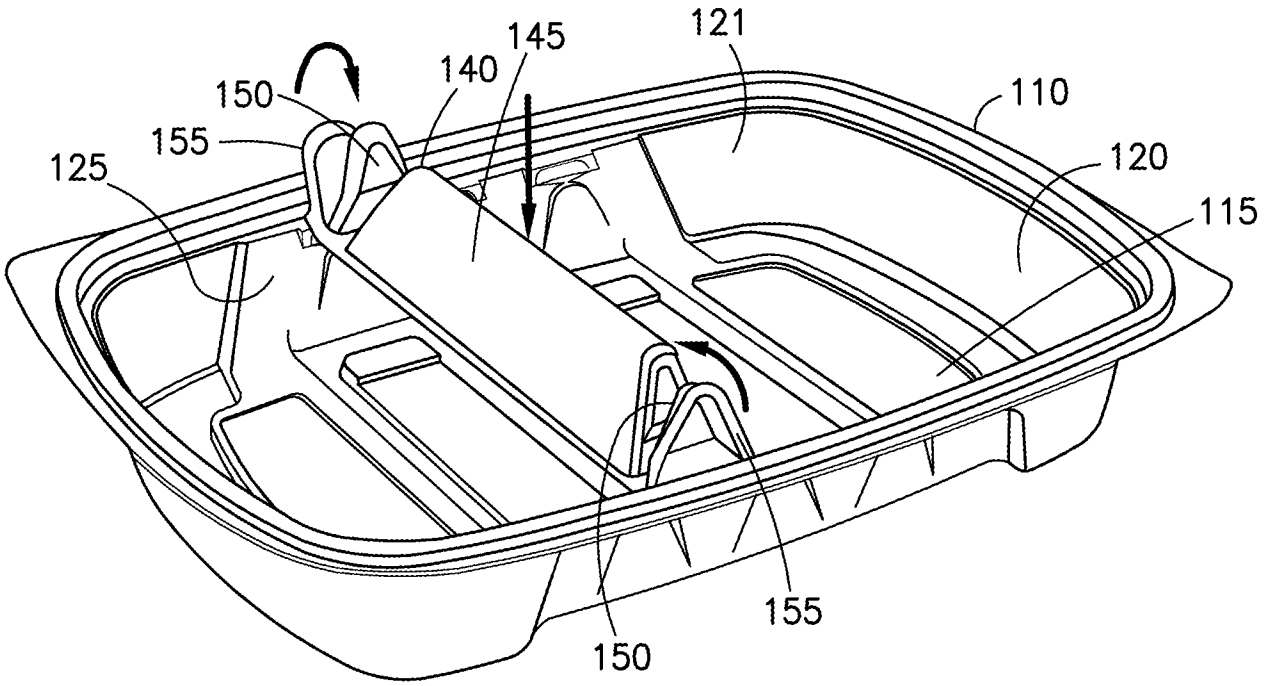
Figure 2C:
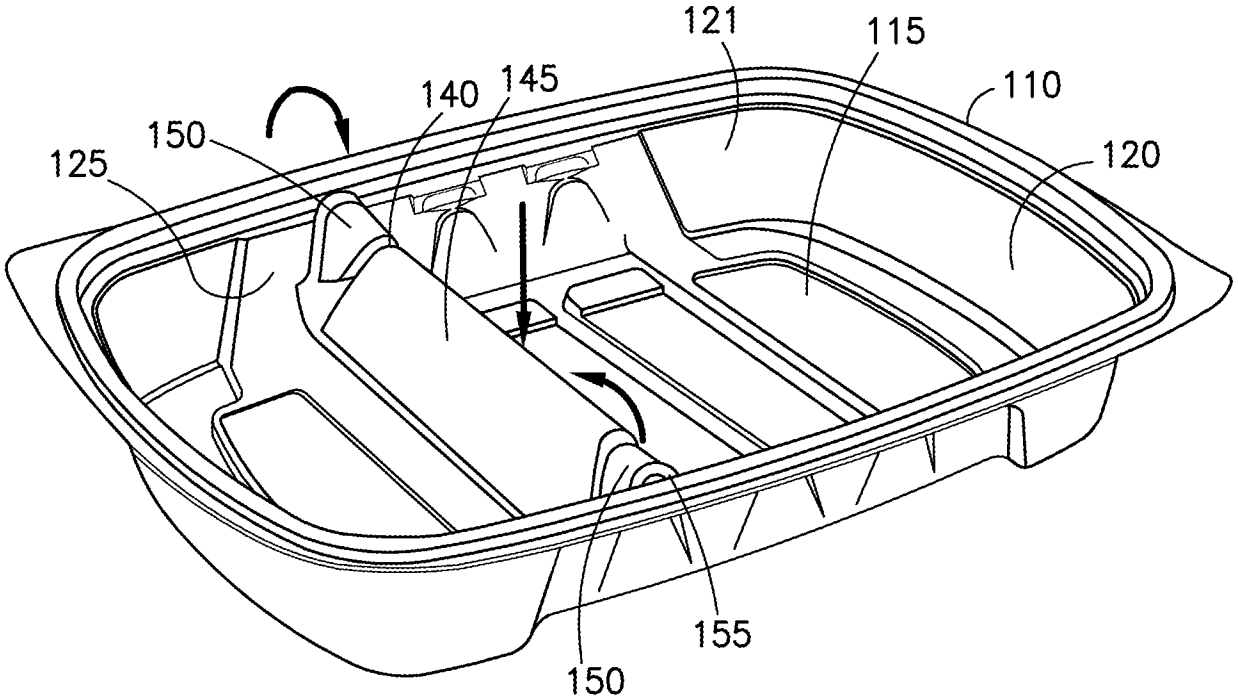

FIG. 2B shows a divider, e.g., barrier 140, being releasably attached to the base 110. In the embodiment depicted, the barrier 140 has an approximately triangular, prismatic profile with its apex positioned away from the bottom surface of the base 140. The top of the barrier 140 is just below the rim 122 of the base 110 (see FIG. 2D). The barrier 140 has a main elongated body 145 and connection features, e.g., tab portions 150, at each end which are hinged to the elongated body 145. Each tab portion 150 has an opening 155 on the underside thereof and the respective protrusion 130 of the one or more pairs of opposing protrusions 130 is sized and shaped to fit at least partially within the opening 155 on the underside of each tab portion 150 to form the press-fit coupling. The tab portions 150 pivot, e.g., bend inward as shown by the curved arrows in FIG. 2C toward the elongated body 145 as the barrier 140 is pressed downward as shown by the straight arrow in FIG. 2C toward the bottom 115 of the base 110 until the barrier 140 snaps into place, e.g., forms a snap fit or press-fit coupling, with the locking features (e.g., protrusions 130 and indents 135) on the parallel wall portions (e.g., regions 125). Once in place, the barrier 140 is secured to the base 110 but can be removed by moving at least one of the tab portions 150 inward to disengage it from the respective protrusion 130 and indents 135, whereupon the barrier 140 can be lifted out of the base 110.

Figure 2D:
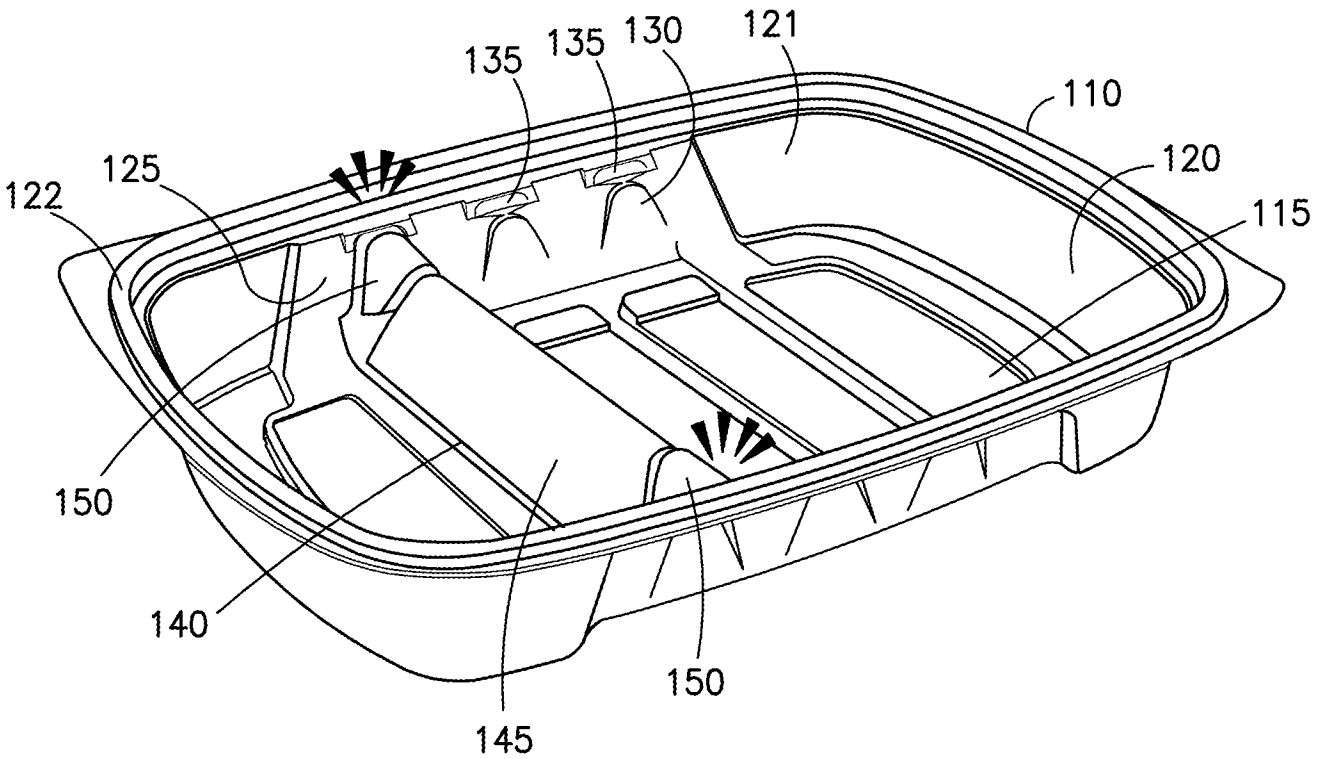

As shown in FIGS. 2A and 2D, each of the regions 125 of the opposing pair of sidewalls 120 includes one or more indents 135 positioned in correspondence with the protrusions 130 to engage with a longitudinal end 158 (see FIG. 3) of each tab portion 150. In the example depicted, each of the regions 125 of the opposing pair of sidewalls 120 includes at least three pairs of opposing protrusions 130 positioned so that the interior volume of the base 110 can be selectively divided into at least: two equally-sized portions; an approximately one-third portion and an approximately two-thirds portion; and three approximately one-third portions. Of course, if no barrier 140 is installed, then the interior volume of the base 110 will be a single, undivided volume.

Figure 3:
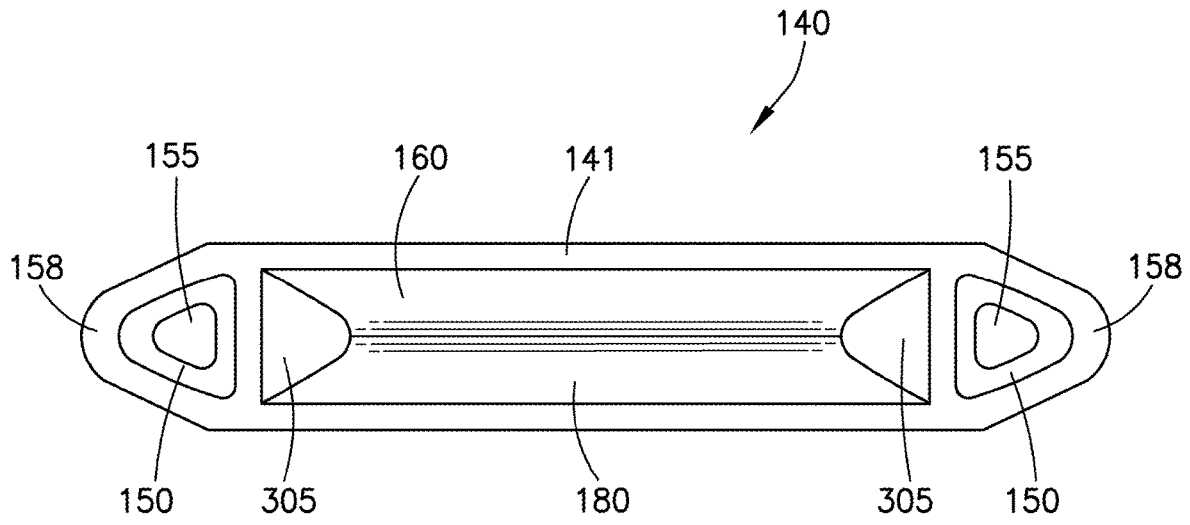
FIG. 3 is an underside view of the barrier to be installed in the base of the modular container system, according to at least one illustrated implementation.
Figure 4:
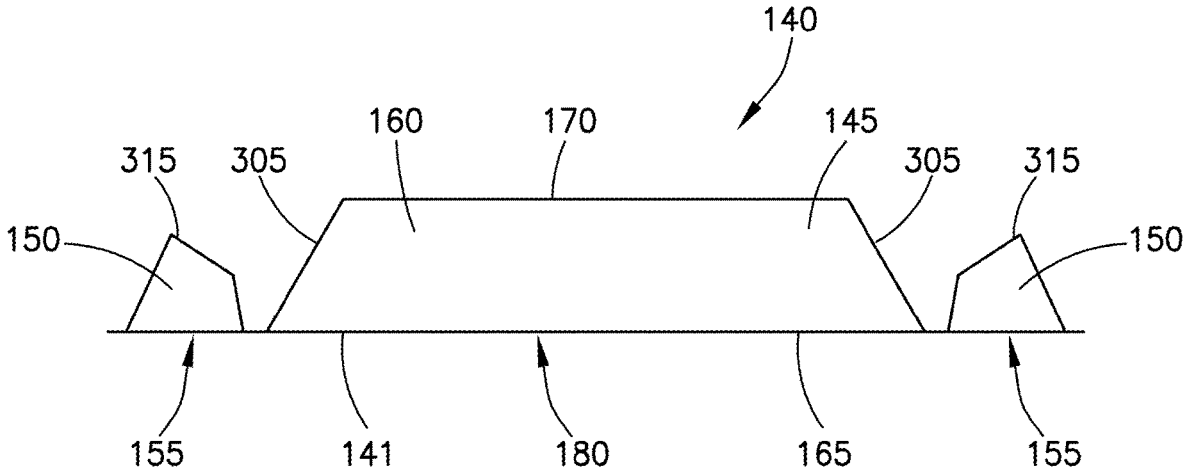
FIG. 4 is a side view of the barrier to be installed in the base of the modular container system, according to at least one illustrated implementation.

FIG. 3 is an underside view of the barrier 140 to be installed in the base 110 of the modular container system 100, and FIG. 4 is a side view of the barrier 140, according to at least one illustrated implementation. In implementations, the barrier 140 has a bottom surface 141 or edge which meets the bottom 115 of the base 110 when the barrier 140 is installed therein. As discussed above, each tab portion 150 may have an opening 155 on the underside thereof. The respective protrusion 130 of the one or more pairs of opposing protrusions 130 may be sized and shaped to fit at least partially within the opening 155 on the underside of each tab portion 150 to form the press-fit coupling.

The body 145 of the at least one barrier 140 has sides 160 which slope so that a transverse width of the body 145 narrows from the bottom 165 of the body 145 to the top 170 of the body 145. The body 145 of the barrier 140 may have ends 305 which slope so that a longitudinal length of the body 145 narrows from the bottom 165 of the body 145 to the top 170 of the body 145. Furthermore, each tab portion 150 of the barrier 140 may have a top 315 which slopes so that a height of each tab portion 150 decreases in the longitudinal direction of the body 145 from an end of the body 145 to a longitudinal middle of the body 145.

In implementations, an interior surface of the bottom 115 of the base 110 may include raised tabs 175 (see FIG. 2A) spaced apart from the opposing pair of sidewalls 120. The raised tabs 175 may be positioned to engage with ends of an underside opening 180 of the body 145 of the barrier 140. In addition, the interior surface of the bottom 115 of the base 110 may include at least one elongate raised portion 185 (see FIG. 2A) which is positioned and shaped to fit within the underside opening 180 of the body 145 of the barrier 140.

Figure 5:
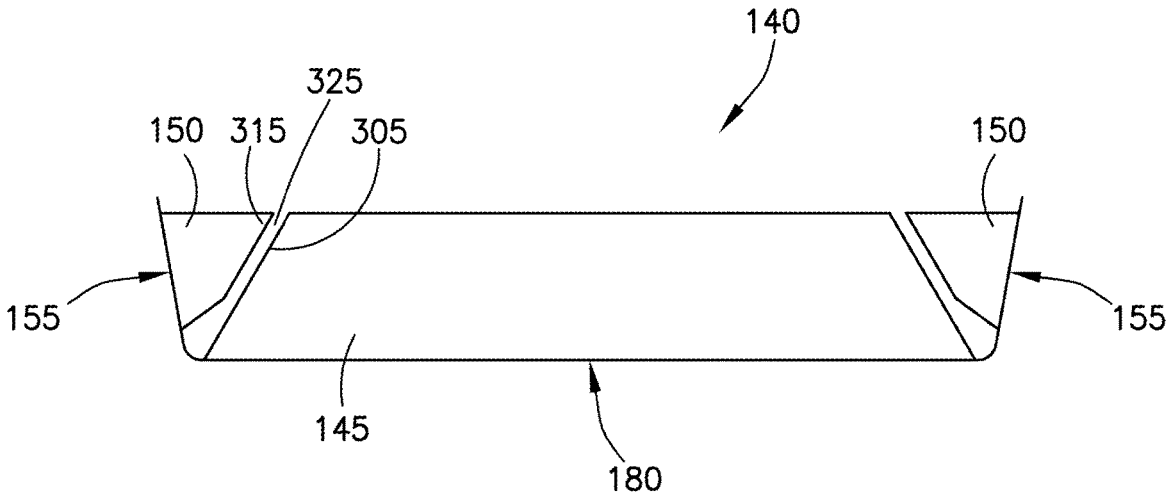
FIG. 5 is a side view of a barrier with tab portions bent to orient an underside of each tab portion to face a respective protrusion to form a press-fit coupling, according to at least one illustrated implementation.

FIG. 5 is a side view of the barrier 140 with tab portions 150 bent to orient an underside 155 of each tab portion 150 to face a respective protrusion 130 to form a press-fit coupling (see FIGS. 2C and 2D), according to at least one illustrated implementation. In implementations, the ends 305 of the body 145 of the barrier 140 may be sloped inward in a longitudinal direction of the body 145, and each tab portion 150 of the barrier 140 may have a sloped top 315, such that the sloped ends 305 of the body 145 of the barrier 140 and the sloped top 315 of each tab portion 150 are substantially parallel when each tab portion 150 is bent toward the body 145 in making the press-fit coupling with the respective protrusion 130 of the base (see FIGS. 2A-2D). A gap 325 may be formed between the substantially parallel sloped ends 305 of the body 145 of the barrier 140 and the sloped top 315 of each tab portion 150. When the press-fit coupling is made between each tab portion 150 and the respective protrusion 130. To separate the barrier from the base, e.g., for washing and reusing after an initial use, the gap 325 provides space for each tab portion 150 to be moved inward, in a longitudinal direction of the body 145, toward the middle of the body 145 to disengage the press-fit coupling between each tab portion 150 and the respective protrusion 130 of the one or more pairs of opposing protrusions.

Figure 6:
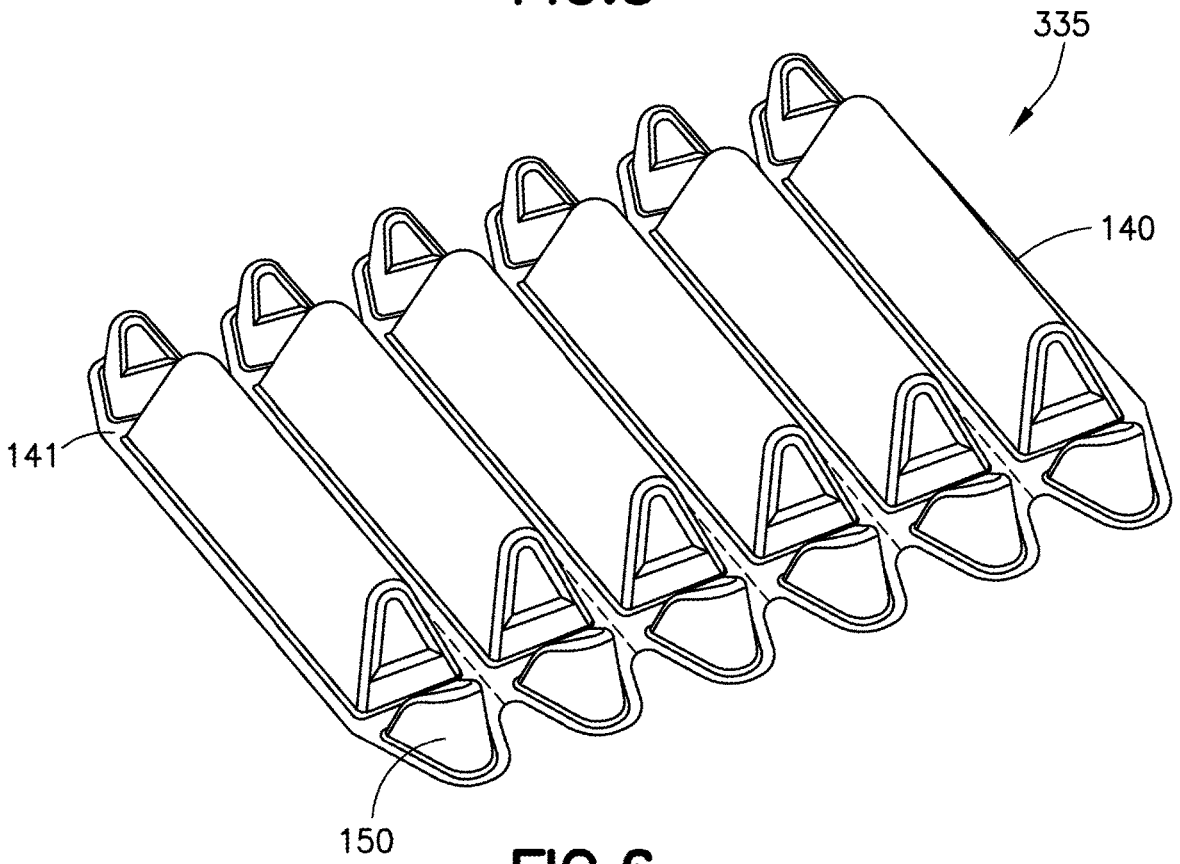
FIG. 6 is a perspective view of a barrier formed as part of a set of barriers which are detachably connected as a single sheet, according to at least one illustrated implementation.

FIG. 6 is a perspective view of barriers 140 formed as a single "tear away" sheet 335, according to at least one illustrated implementation. In implementations, the at least one barrier 140 may be formed as part of a set of barriers which are detachably connected as a single sheet 335. The barriers 140 may be connected by a common bottom surface 141 or edge, which may have perforations to delineate each individual barrier 140. The barriers 140 presented in a sheet 335 configuration can be nested (i.e., stacked) with other like sheets for easy and efficient storage or stored in a spool-type arrangement.

Figure 7:
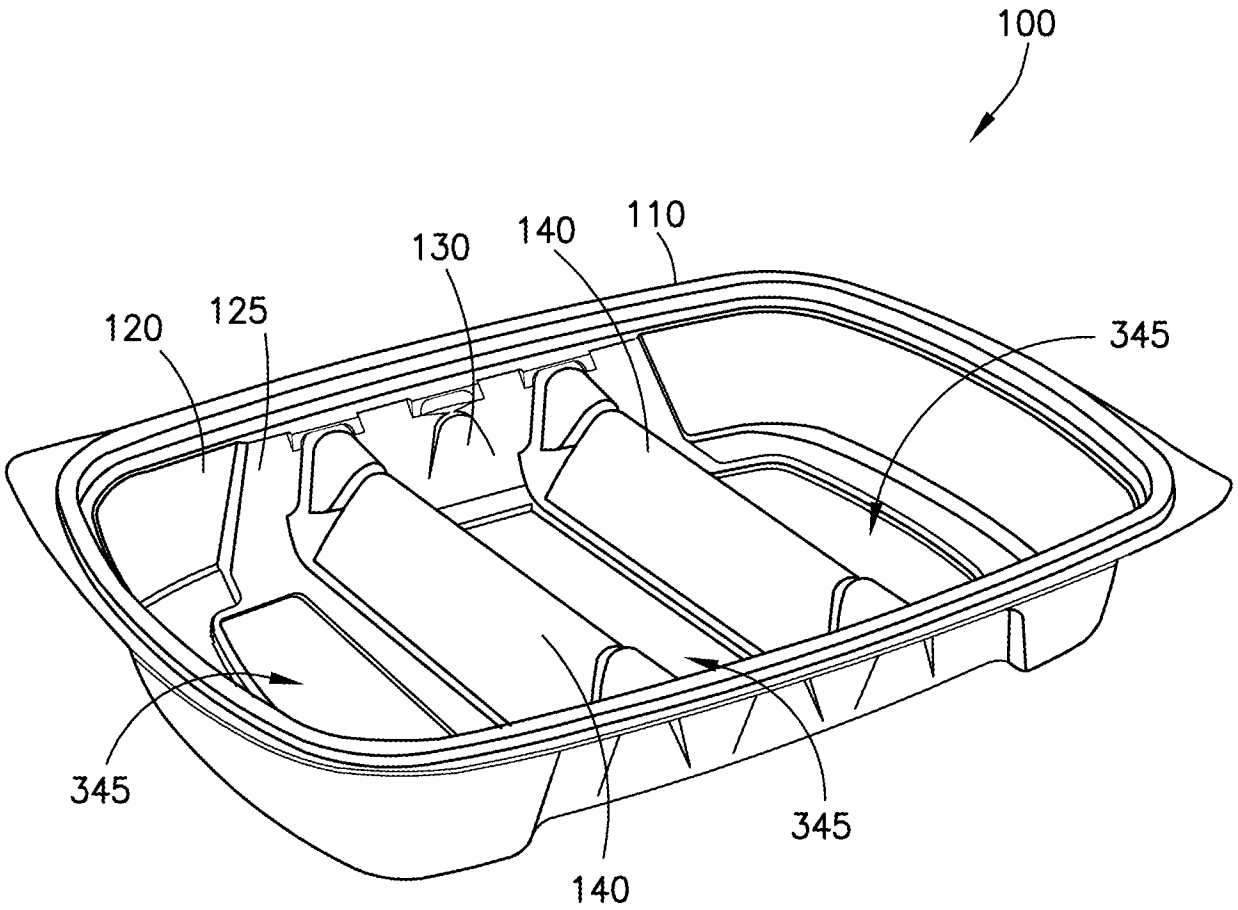
FIG. 7 is a perspective view of two barriers installed in a base having an interior divided into three compartments, according to at least one illustrated implementation.

FIG. 7 is a perspective view of a modular container system 100 having an interior divided into compartments 345, according to at least one illustrated implementation. The regions 125 of the opposing pair of sidewalls 120 may include three pairs of opposing protrusions 130 (only one side of each pair is directly visible in the figure) positioned so that the interior volume of the base 110 can be selectively divided into: two equally-sized portions; an approximately one-third portion and an approximately two-thirds portion; and three approximately one-third portions. In the example depicted, two barriers 140 have been installed to divide the base 110 into three approximately one-third portions.

The various embodiments described above can be combined and/or modified to provide further embodiments in light of the above-detailed description, including the material incorporated by reference. In general, in the following claims, the terms used should not be construed to limit the claims to the specific implementations disclosed in the specification and the claims, but should be construed to include all possible implementations along with the full scope of equivalents to which such claims are entitled. Accordingly, the claims are not limited by the disclosure.

What is claimed is:

1. A modular container system having an interior dividable into compartments of variable size, the container system comprising:

a base having a bottom and sidewalls extending from the bottom to define an interior volume, at least one opposing pair of the sidewalls having regions arranged opposite each other, each of the regions including one or more protrusions to form one or more pairs of opposing protrusions, each of the regions further including one or more indents positioned in correspondence with the one or more protrusions, the base having a rim at a peripheral upper edge of the sidewalls; and at least one barrier to extend between the one or more pairs of opposing protrusions to divide the interior volume of the base into a plurality of compartments, the at least one barrier having an elongate body and a tab portion extending from each end of the body, each said tab portion being bendable to orient an underside of each said tab portion to face a respective protrusion of the one or more pairs of opposing protrusions, a longitudinal end of each said tab portion engaging with a corresponding indent of the one or more indents, to form a removable press-fit coupling between each said tab portion and the respective protrusion of the one or more pairs of opposing protrusions and the corresponding indent of the one or more indents, such that when the at least one barrier is so positioned, a length of the barrier is substantially the same as a distance between the regions of the at least one opposing pair of the sidewalls.

2. The modular container system of claim 1, wherein each said tab portion has an opening on the underside thereof and the respective protrusion of the one or more pairs of opposing protrusions is sized and shaped to fit at least partially within the opening on the underside of each said tab portion when forming the press-fit coupling.

3. The modular container system of claim 1, wherein the regions of the at least one opposing pair of the sidewalls are substantially planar.

4. The modular container system of claim 1, further comprising a lid having a rim at a peripheral edge thereof to attach in a removable press-fit engagement to the rim of the base.

5. The modular container system of claim 1, wherein at least one barrier is formed as part of a plurality of barriers which are detachably connected to each other as a single sheet.

6. The modular container system of claim 1, wherein the body of the at least one barrier has sides which slope so that a transverse width of the body narrows from a bottom of the body to a top of the body.

7. The modular container system of claim 6, wherein the body of the at least one barrier has ends which slope so that a longitudinal length of the body narrows from a bottom of the body to a top of the body.

8. The modular container system of claim 7, wherein each said tab portion of the at least one barrier has a top which slopes so that a height of each said tab portion decreases in the longitudinal direction of the body from an end of the body to a longitudinal middle of the body.

9. The modular container system of claim 8, wherein the sloped ends of the body of the at least one barrier and the sloped top of each said tab portion, respectively, are shaped to be substantially parallel when the press-fit coupling is made between each said tab portion and the respective protrusion of the one or more pairs of opposing protrusions and the corresponding indent of the one or more indents.

10. The modular container system of claim 9, wherein the substantially parallel sloped ends of the body of the at least one barrier and the sloped top of each said tab portion, respectively, have a gap therebetween, when the press-fit coupling is made between each said tab portion and the respective protrusion of the one or more pairs of opposing protrusions and the corresponding indent of the one or more indents, to provide space for each said tab portion to be moved inward, in a longitudinal direction of the body, toward the middle of the body to disengage the press-fit coupling.

11. The modular container system of claim 1, wherein each of the regions of the at least one opposing pair of the sidewalls includes at least two pairs of opposing protrusions positioned so that the interior volume of the base can be selectively divided into at least: an approximately one-third portion and an approximately two-thirds portion; and three approximately one-third portions.

12. The modular container system of claim 1, wherein each of the regions of the at least one opposing pair of the sidewalls includes at least three pairs of opposing protrusions positioned so that the interior volume of the base can be selectively divided into at least: two equally-sized portions; an approximately one-third portion and an approximately two-thirds portion; and three approximately one-third portions.

13. The modular container system of claim 1, wherein an interior surface of the bottom of the base includes at least one elongate raised portion positioned and shaped to fit within an underside opening of the body of the at least one barrier, the raised portion including raised tabs at ends thereof, the raised tabs positioned to engage with ends of the underside opening of the body of the at least one barrier.

14. The modular container system of claim 1, wherein an interior surface of the bottom of the base includes raised tabs spaced apart from the at least one opposing pair of the sidewalls, the raised tabs positioned to engage with ends of an underside opening of the body of the at least one barrier.

15. A plastic container having an interior dividable into compartments of variable size, the container comprising:

at least one barrier; and a base adapted to receive the at least one barrier to divide an interior volume of the base into a plurality of compartments, the base comprising:

a bottom having an interior surface, sidewalls extending from the bottom to define the interior volume, at least one opposing pair of the sidewalls having regions arranged opposite each other, each of the regions including one or more protrusions to form one or more pairs of opposing protrusions, each of the regions further including one or more indents positioned in correspondence with the one or more protrusions, the one or more pairs of opposing protrusions adapted to receive the at least one barrier extending therebetween, the one or more pairs of opposing protrusions forming a press-fit coupling between each protrusion of the one or more pairs of opposing protrusions and a corresponding indent of the one or more indents and a respective bendable tab portion extending from each end of an elongate body portion of the at least one barrier, the corresponding indent of the one or more indents engaging with a longitudinal end of each said tab portion, and a rim at a peripheral upper edge of the sidewalls.

16. The plastic container of claim 15, further comprising a lid having a rim at a peripheral edge thereof to attach to the rim of the base.

17. The plastic container of claim 15, wherein the one or more pairs of opposing protrusions of the base are positioned and shaped so that the respective bendable tab portion of the at least one barrier is bendable to orient an underside of each said tab portion to face a respective protrusion of the one or more pairs of opposing protrusions.

18. The container of claim 15, wherein the interior surface of the bottom of the base includes at least one elongate raised portion positioned and shaped to fit within an underside opening of the body of the at least one barrier, the raised portion including raised tabs at ends thereof, the raised tabs positioned to engage with ends of the underside opening of the body of the at least one barrier.

19. The container of claim 15, wherein an interior surface of the bottom of the base includes raised tabs spaced apart from the at least one opposing pair of the sidewalls, the raised tabs positioned to engage with ends of an underside opening of the body of the at least one barrier.

* * * * *